US007182421B2

(12) United States Patent
Kobayashi et al.

(10) Patent No.: US 7,182,421 B2
(45) Date of Patent: Feb. 27, 2007

(54) INKJET DEVICE AND METHOD CAPABLE OF PROVIDING HIGHLY ACCURATE POSITIONING OF INK INJECTION

(75) Inventors: Shinya Kobayashi, Ibaraki-ken (JP); Hitoshi Kida, Ibaraki-ken (JP); Yoshihiro Arai, Chiba-ken (JP)

(73) Assignee: Ricoh Printing Systems Ltd., Tokyo (JP)

( * ) Notice: Subject to any disclaimer, the term of this patent is extended or adjusted under 35 U.S.C. 154(b) by 220 days.

(21) Appl. No.: 10/753,876

(22) Filed: Jan. 9, 2004

(65) Prior Publication Data

US 2004/0183842 A1 Sep. 23, 2004

(30) Foreign Application Priority Data

Jan. 10, 2003 (JP) ..... 2003-003909
Jan. 8, 2004 (JP) ..... 2004-003489

(51) Int. Cl.
*B41J 29/38* (2006.01)

(52) U.S. Cl. ..... 347/9; 347/5

(58) Field of Classification Search ..... 347/54, 347/10

See application file for complete search history.

(56) References Cited

U.S. PATENT DOCUMENTS 6,027,197 A * 2/2000 Kaburagi et al. ..... 347/9
6,328,395 B1 * 12/2001 Kitahara et al. ..... 347/9
6,345,875 B1 * 2/2002 Fuller et al. ..... 347/9
6,431,676 B2 * 8/2002 Asauchi et al. ..... 347/10
6,645,029 B2 * 11/2003 Akahira ..... 445/24
6,749,279 B2 * 6/2004 Kobayashi et al. ..... 347/14
6,758,550 B2 * 7/2004 Ito et al. ..... 347/40
6,779,863 B2 * 8/2004 Usuda ..... 347/14
7,031,557 B2 * 4/2006 Huang ..... 382/318

* cited by examiner

*Primary Examiner*—Vip Patel
*Assistant Examiner*—Shelby Fidler
(74) *Attorney, Agent, or Firm*—Whitham, Curtis, Christofferson & Cook, PC

(57) ABSTRACT

In an inkjet device that ejects ink on a medium with an inkjet head, data conversion software generates ejection data and timing control data from pattern data that describe patterns of ejection target pixels. A timing control board outputs a drive waveform generation trigger signal and a data transfer request signal to a drive waveform generator board and a memory board, respectively. The drive waveform generator board generates drive waveforms according to drive waveform generation trigger signal. The memory board transfers ejection data to the driver board according to the data transfer request signal. The driver board controls ink ejection of each nozzle based on the ejection data. Therefore, the inkjet device is capable of highly accurate positioning of ink ejection with almost no increase in the amount of data.

10 Claims, 12 Drawing Sheets

FIG.7(1)

207

0100 1101 0001 1010 010 209
0100 0101 0000 1010 000 210

208

(L2)01100
(L6)00001
(L8)01100
(L13)00001
(L15)01100

TOTAL OF 63 BIT

FIG.7(2)

(L1)00000
(L2)01100
(L3)00000
(L4)00000
(L5)01100
(L6)00001
(L7)00000
(L8)01100
(L9)00000
(L10)00000
(L11)00000
(L12)01100
(L13)00001
(L14)00000
(L15)01100
(L16)00000
(L17)00000
(L18)01100
(L19)00000

TOTAL OF 95 BIT

| | | M0 | M1 | M2 | M3 | M4 |
|---|---|---|---|---|---|---|
| 407 1101 | DRIVE WAVEFORM GENERATION | 0 | 1 | 1 | 1 | 1 |
| 407 1102 | COATING DATA TRANSFER | 0 | 0 | 0 | 1 | 1 |
| 407 1103 | DATA ROTATION | * | 0 | 1 | 0 | 1 |
| | LATCH CLOCK L-CK | 0 | 0 | 1 | 1 | 1 |
| | SHIFT CLOCK S-CK | 0 | 0 | 1 | 1 | 1 |
| 408 1104 | SWITCH S1 | * | * | S1B | S1A | S1A |
| 408 1105 | SWITCH S2 | * | * | CLOSE | OPEN | CLOSE |

INKJET DEVICE AND METHOD CAPABLE OF PROVIDING HIGHLY ACCURATE POSITIONING OF INK INJECTION

BACKGROUND OF THE INVENTION

1. Field of the Invention

The present invention relates to an inkjet device, and more particularly to an inkjet device that is capable of ejecting ink accurately on a medium.

2. Description of Related Art

A printer is the most common device for recording digital image data on a medium. Inkjet printers, which offer high-quality images at low cost, are the most popular printer type. Because the inkjet printers can record images without contacting a medium, the inkjet printers are now considered for use in the manufacture of semiconductors, liquid crystal displays (LCD), organic electroluminescence (EL) displays and other displays.

SUMMARY OF THE INVENTION

However, there are problems that have to be solved to use inkjet devices for manufacturing the above displays. The resolution of images recorded by inkjet printers (expressed in dpi: dot/inch) is commonly 600 dpi. By contrast, the resolution of display pixels formed on the displays (expressed in ppi: pixel/inch) is commonly 100 ppi, which is considerably lower (coarser) than the resolution of images by inkjet printers.

On the other hand, the accuracy required In positioning images on paper or other recording media is not very strict. For instance, an accuracy of 0.1 mm is sufficient even when printing images on a preprinted paper. With display pixels, by contrast, a medium is a patterned glass substrate where the accuracy required in positioning ink on the pattern is approximately 1 μm (1/24500 inch), which is extremely strict. This accuracy can be achieved by increasing the resolution to 25400 dpi, but this generates 1800 times as much data as for 600 dpi recording, which is unrealistic. Since the actual resolution of display pixels is only 100 ppi, recording those 100-ppi pixels at a resolution of 25400 dpi requires an unreasonable amount of data and is inefficient.

There is another method of accurately positioning the initial ink ejection and then repeatedly recording pixels accurately at regular intervals of 100 ppi for subsequent ink ejection. This method can avoid increasing the amount of data. However, this method works only when all the display pixels are located on lines at 100 ppi intervals. In actual use, there are also test pixels located on the circumference of display cells in which display pixels are arranged. Generally, the test pixels are not located on the lines at 100 ppi intervals like the display pixels. The medium used here is 1 m square substrate, and the substrate includes a plurality of display cells. When the intervals of the plurality of display cells are not multiple numbers of the intervals of display pixels, all the display pixels in some of the plurality of display cells are not located on the lines at 100 ppi intervals. Accordingly, this method of using accurate positioning only for initial ejection followed by repeated ejection at regular intervals cannot be used.

In view of the foregoing, it is an objective of the present invention to provide an inkjet device capable of highly accurate positioning of ink ejection with almost no increase in the amount of digital image data.

In order to attain the above and other objects, the present invention provides an inkjet device. The inkjet device includes an inkjet head having multiple nozzles arranged at equally spaced intervals in a row, the inkjet head ejecting ink droplets from the multiple nozzles onto target pixels on a medium, a data generating unit that generates both ejection data and timing control data from pattern data, a drive-waveform-generation-signal generating unit that generates a drive-waveform generation signal in accordance with the timing control data, a transfer-signal generating unit that generates a transfer signal in accordance with the timing control data, a drive-waveform generating unit that generates a drive waveform in accordance with the drive-waveform generation signal, an ejection-data transferring unit that transfers the ejection data in accordance with the transfer signal, and a control unit that controls, based on the drive waveform and the ejection data transferred from the ejection-data transferring unit, the inkjet head to selectively eject ink droplets from the multiple nozzles.

The present invention also provides a control method for controlling an inkjet device. The control method includes the steps of a) generating ejection data and timing control data from pattern data, b) generating a drive-waveform generation signal in accordance with the timing control data, c) generating a transfer signal in accordance with the timing control data, d) transfering the ejection data to a register in accordance with the transfer signal, e) generating a drive waveform in accordance with the drive-waveform generation signal, and f) controlling, based on the drive waveform generated in step d) and the ejection data stored in the register, an inkjet head to selectively eject ink droplets from multiple nozzles of the inkjet head onto target pixels on a medium.

BRIEF DESCRIPTION OF THE DRAWINGS

The above and other objects, features and advantages of the invention will become more apparent from reading the following description of the preferred embodiments taken in connection with the accompanying drawings in which:

FIG. 5(2) is an enlarged view showing a region A of the pattern substrate shown in FIG. 5(1);

FIG. 7(1) is an explanatory diagram showing a size of timing control data and ejection data according to the first embodiment;

FIG. 7(2) is an explanatory diagram showing a size of timing control data and ejection data according to a conventional method;

DETAILED DESCRIPTION OF THE PREFERRED EMBODIMENTS

Figure 1:
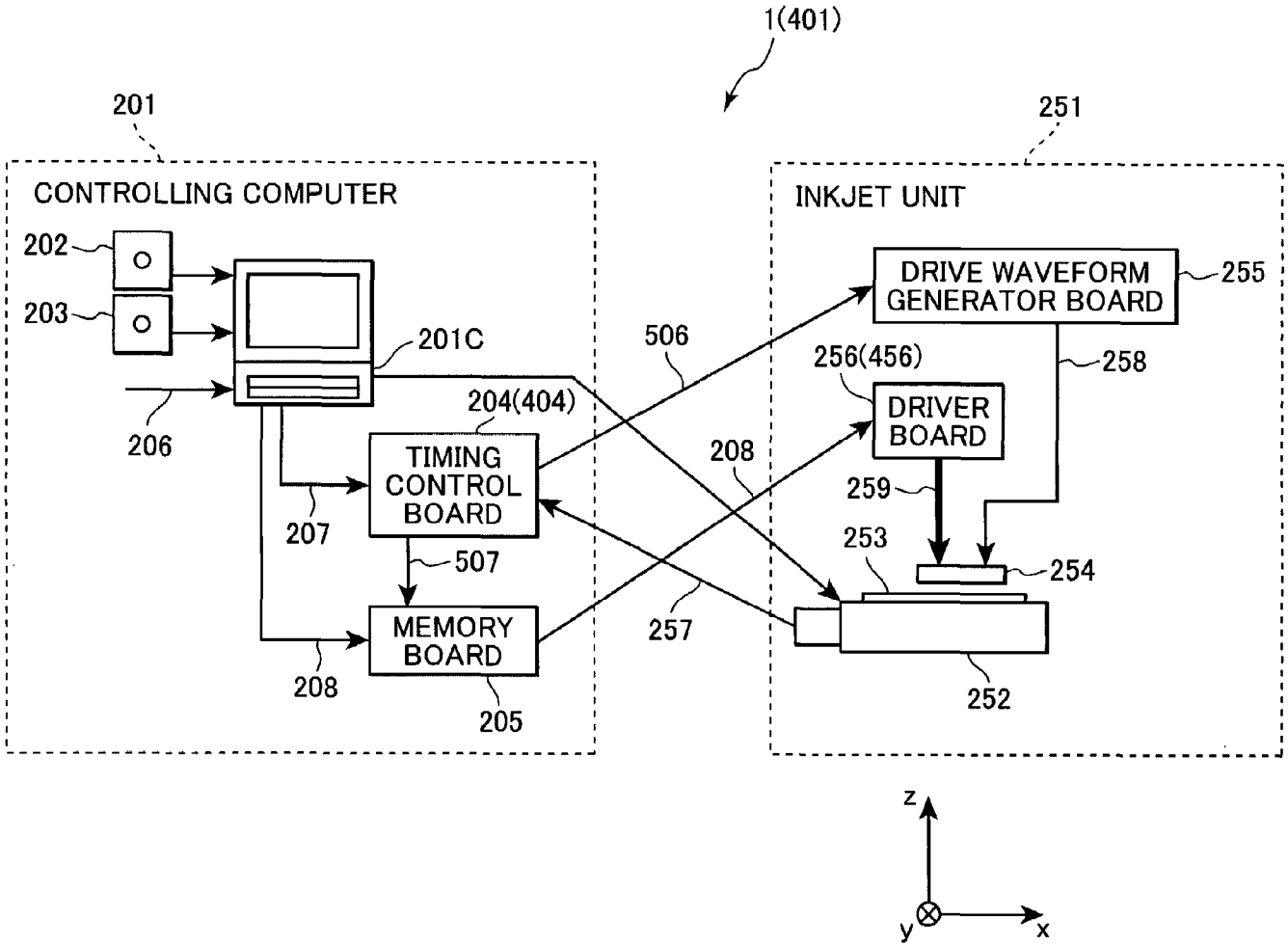
FIG. 1 is an explanatory diagram showing the overall construction of an inkjet device according to a first embodiment of the present invention.

An inkjet device according to preferred embodiments of the present invention will be described while referring to the accompanying drawings wherein like parts and components are designated by the same reference numerals to avoid duplicating description.

First, an explanation of digital image data will be provided. Digital image data are data obtained by sampling and quantization of photographs and other analog images.

Sampling is a process to extract data discretely from a continuous analog image. Recent printers sample image data at 600 dpi (dot/inch) in x and y directions. This density is hereinafter referred to as resolution. The sampled square area of 1/600 inch in x and y directions is referred to as a pixel The center position of the pixel is defined as a location of the pixel. Sampled data is generally an average optical reflection density of the pixel area or a related amount. The sampled data are referred to as pixel data.

Quantization is a representation of the pixel data using a limited number of levels. For example, 256 levels per color are used to reproduce a photographic image. However, in the present embodiment, an explanation will be made about an example where a monochrome color is quantized to two values, that is, black as 1 and white as 0.

Digital image data is a set of pixel data arrayed in x and y directions. In this embodiment, the number of the arrays in x and y directions of image data are initially defined, and the pixel data are filled into the arrays in a BMP (bitmap) data format or the like.

The inkjet device according to the first embodiment of the present invention will be described with reference to FIGS. 1 to 8.

FIG. 1 is an explanatory diagram showing the overall construction of the inkjet device 1 in the first embodiment. As shown in FIG. 1, x-axis is defined in a direction parallel with the sheet of drawing, and z-axis is defined perpendicular to the x-axis and in a direction parallel with the sheet of drawing. Y-axis is defined perpendicular to both the x-axis and the z-axis, that is, perpendicular to the sheet of drawing.

The inkjet device 1 includes a controlling computer 201 and an inkjet unit 251. The controlling computer 201 includes a controlling computer main unit 201C, a timing control board 204, and a memory board 205. The inkjet unit 251 includes an X-Y stage 252 well-known in the art, an inkjet head 254 well-known in the art, a drive waveform generator board 255, and a driver board 256. The inkjet unit 251 further includes an optical system for detecting the position of a pattern substrate 253 and an ink supply system and maintenance system for the inkjet head 254 not shown in the drawings.

Figure 6:
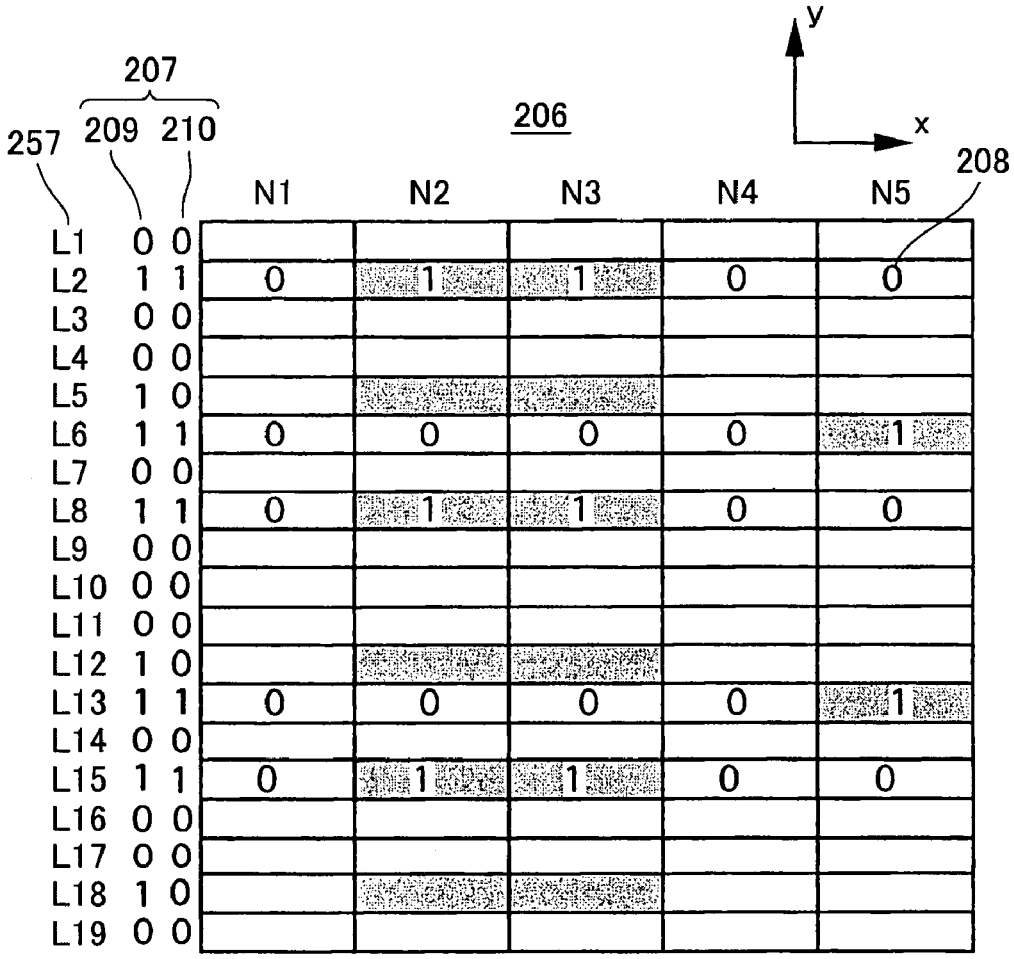
FIG. 6 is an explanatory diagram of data conversion software that generates ejection data and timing control data from pattern data.

The controlling computer main unit 201C includes data conversion software 202 and stage control software 203. The data conversion software 202 generates timing control data 207 and ejection data 208 from pattern data 206, and stores the timing control data 207 and the ejection data 208 in the timing control board 204 and the memory board 205, respectively, via a bus (not shown) of the controlling computer main unit 201C. As shown in FIG. 6, the timing control data 207 include drive waveform generation timing data 209 and ejection data transfer timing data 210. Detailed descriptions will be provided later. The stage control software 203 controls the X-Y stage 252.

The timing control board 204 and the memory board 205 are inserted in a board slot (not shown) of the controlling computer main unit 201C, and are connected to the bus (not shown). The timing control board 204 outputs a drive waveform generation trigger signal 506 and a data transfer request signal 507 to the drive waveform generator board 255 and the memory board 205, respectively. The memory board 205 has a transfer function. The memory board 205 transfers the ejection data 208 to the driver board 256 according to the data transfer request signal 507. The memory board 205 is well known in the art, thus descriptions of its construction are omitted.

The X-Y stage 252 is movable in the x and y directions. The pattern substrate 253 is loaded on the X-Y stage 252. Here, y direction indicates a main scanning direction, and x direction indicates a sub-scanning direction. The X-Y stage 252 has an encoder (not shown) for outputting a y-direction encoder output 257. The resolution of the y-direction encoder output 257 is 1 μm in this embodiment.

The inkjet head 254 is disposed above the pattern substrate 253, and ejects ink droplets on the pattern substrate 253. During ink ejection, the inkjet head 254 is fixed at a predetermined position, while the pattern substrate 253 is moved in x and y directions by the X-Y stage 252. The drive waveform generator board 255 and the driver board 256 are disposed near the inkjet head 254. The drive waveform generator board 255 generates drive waveforms 258 based on the drive waveform generation trigger signal 506, and sends the generated drive waveforms 258 to the inkjet head 254. The drive waveform generator board 255 is well known in the art, thus descriptions of its construction are omitted. The construction of the driver board 256 will be described later.

Figure 4:
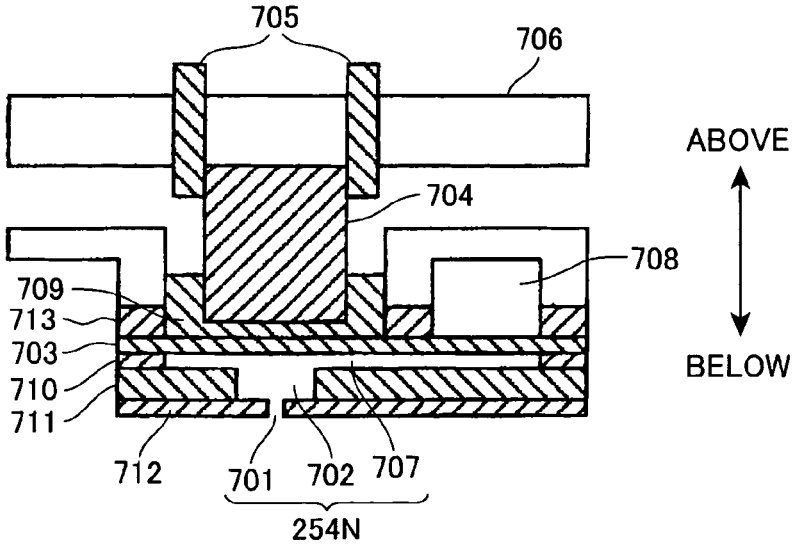
FIG. 4 is a cross-sectional view showing nozzle construction of an inkjet head of the inkjet device shown in FIG. 1.

The inkjet head 254 will be explained in detail with reference to FIG. 4. The inkjet head 254 is a common piezo-electric type on-demand inkjet head. The inkjet device 1 in this embodiment is provided with one inkjet head 254. The inkjet head 254 is formed with 128 nozzles 254N (only one nozzle 254N is shown in FIG. 4) and a common ink supply channel 708. The inkjet head 254 includes an orifice plate 712, a pressure chamber plate 711, a restrictor plate 710, a vibration plate 703, a piezo-electric-element fixing substrate 706, and a support plate 713. The 128 nozzles 254N are arranged in a row in x direction, and spaced at 100 npi (nozzles/inch). Each nozzle 254N has a nozzle opening 701 that is formed in the orifice plate 712, a pressure chamber 702 that is formed in the pressure chamber plate 711, and a restrictor 707 that is formed in the restrictor plate 710. The restrictor 707 connects the common ink supply channel 708 and the pressure chamber 702, and controls ink flow into the pressure chamber 702.

The nozzle 254N further includes a piezo-electric element 704. The piezo-electric element 704 is fixed to the piezo-electric-element fixing substrate 706. The piezo-electric element 704 is connected to the vibration plate 703 by an elastic material 709 such as silicone adhesive, and has a pair of signal input terminals 705. The piezo-electric element 704 is formed and installed such that the element expands and contracts when a voltage is applied to the pair of signal input terminals 705 but otherwise retains its original shape. The support plate 713 reinforces the vibration plate 703.

The vibration plate 703, the restrictor plate 710, the pressure chamber plate 711, and the support plate 713 are made of, for example, stainless steel. The orifice plate 712 is made of nickel. The piezo-electric-element fixing substrate 706 is made of an insulating material such as ceramics, polyimide, or the like.

With the above-described construction, ink is provided from an ink tank (not shown) and flows downward through the common ink supply channel 708, and distributed to each restrictor 707. Ink further flows through the pressure chamber 702 to reach the nozzle opening 701. When a voltage is applied to the pair of signal input terminals 705, the piezo-electric element 704 deforms and a portion of ink in the pressure chamber 702 is ejected from the nozzle opening 701.

Figure 2:
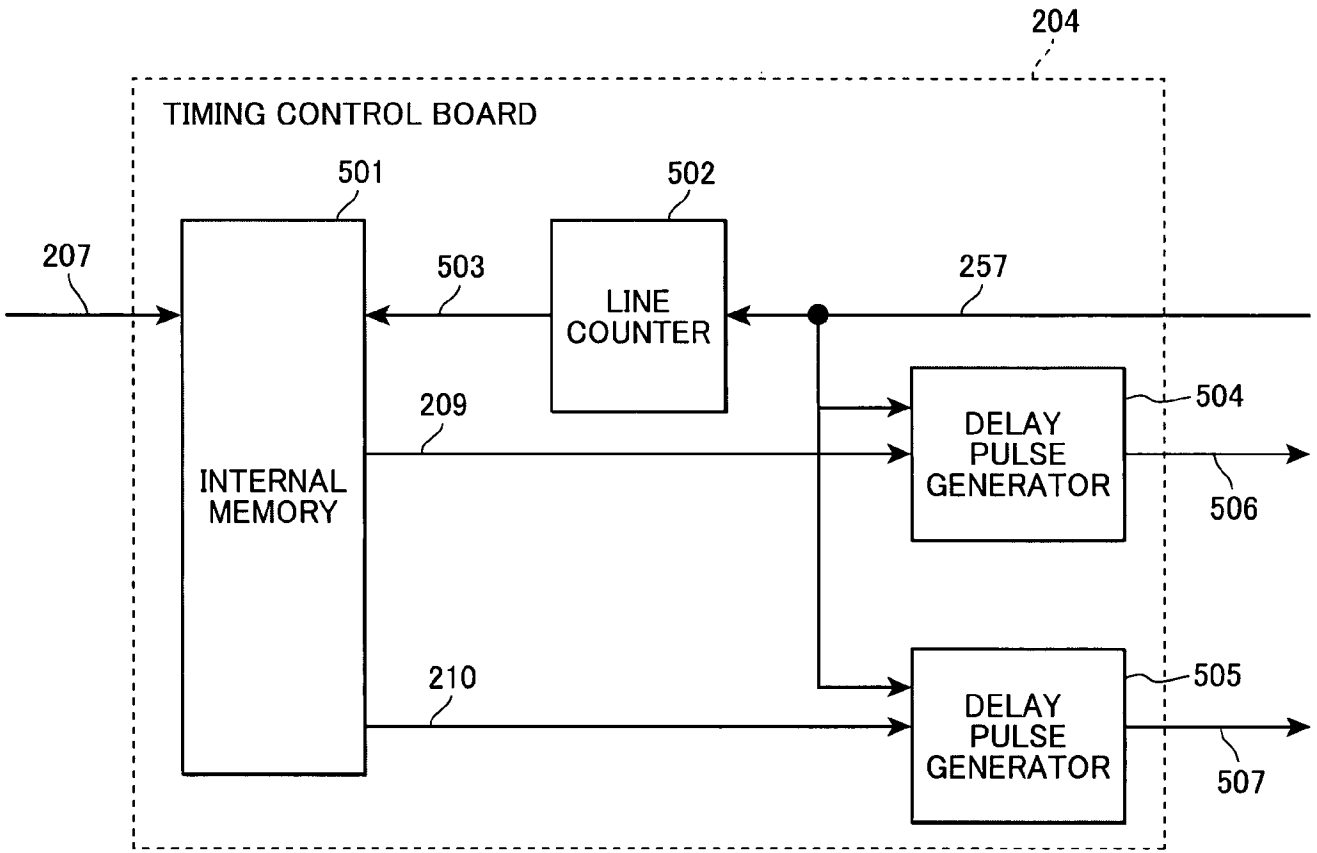
FIG. 2 is a block diagram showing the construction of a timing control board of the inkjet device shown in FIG. 1.

Next, the timing control board 204 will be described with reference to FIGS. 1 and 2. As shown in FIG. 2, the timing control board 204 includes an internal memory 501, a line counter 502, and delay pulse generators 504 and 505. The line counter 502 counts the y-direction encoder output 257 of the X-Y stage 252, and output a signal 503 to the internal memory 501. The timing control data 207 (drive waveform generation timing data 209 and ejection data transfer timing data 210) are generated by the data conversion software 202 and written to the internal memory 501. The internal memory 501 outputs the drive waveform generation timing data 209 and the ejection data transfer timing data 210 to the delay pulse generators 504 and 505, respectively, based on the signal 503. The delay pulse generator 504 outputs the drive waveform generation trigger signal 506 based on the drive waveform generation timing data 209 and the y-direction encoder output 257. Similarly, the delay pulse generator 505 outputs the data transfer request signal 507 based on the ejection data transfer timing data 210 and the y-direction encoder output 257.

Figure 3:
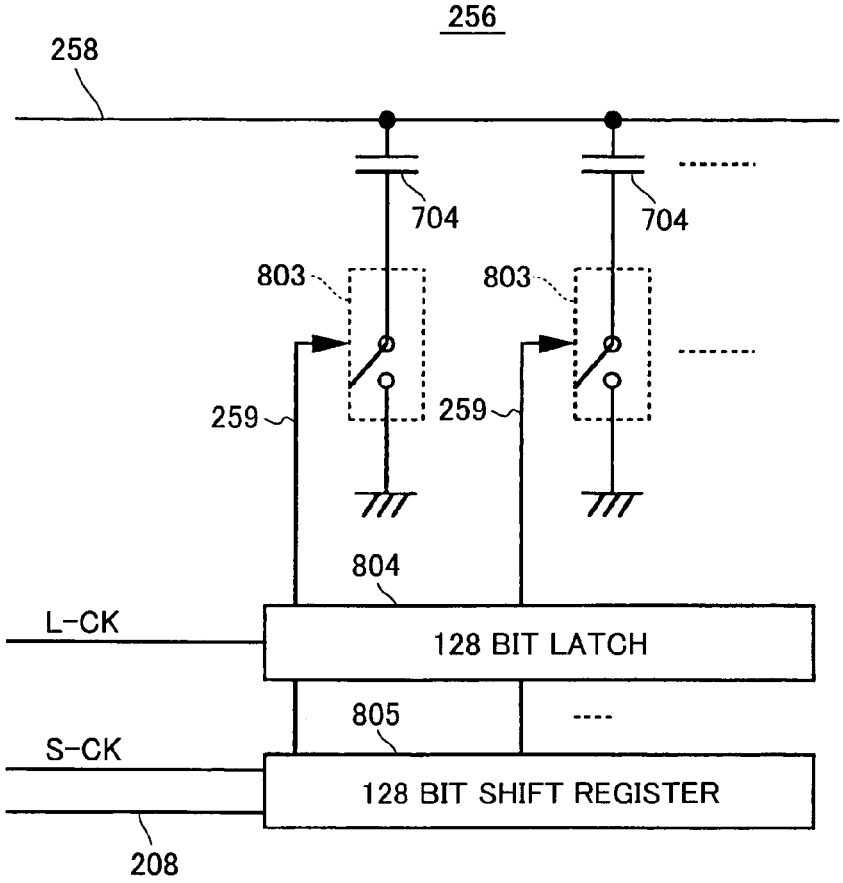
FIG. 3 is an explanatory diagram showing the construction of a driver board of the inkjet device shown in FIG. 1.

The driver board 256 will be described with reference to FIG. 3. Here, the piezo-electric element 704 is shown by a capacitance symbol used in electric circuits. As shown in FIG. 3, the driver board 256 includes 128 switches 803, a 128-bit latch 804, and a 128-bit shift register 805. One side of the pair of signal input terminals 705 (hereinafter referred to as common terminal side) for each piezo-electric element 704 is connected to a common terminal (not shown). The drive waveforms (voltage) 258 (FIG. 8) common to all piezo-electric elements 704 are inputted to the common terminal side. The drive waveforms 258 are amplified to a required strength (for example, 10 Amps) by an amplifier (not shown). The other side of the pair of signal input terminals 705 (hereinafter referred to as individual terminal side) of each piezo-electric element 704 is connected to the switch 803.

The ejection data 208, in synchronization with shift clock S-CK, are inputted to the 128-bit shift register 805 one bit at a time. At this time, the ejection data 208 in the 128-bit shift register 805 are shifted one bit at a time. The ejection data 208 are 128-bit serial data, and each bit corresponds to each nozzle 254N. Logic 1 is defined as ejection of ink, while a logical value of 0 is defined as non-ejection of ink.

The 128-bit latch 804 latches a total of 128-bit parallel data from the shift register 805 in synchronization with latch clock L-CK. The 128-bit latch 804 outputs drive signals 259 to the switch terminals of the 12*a* switches 803. The switch 803 applies a ground voltage to the individual terminal of the piezo-electric element 704 when the drive signal 259 of a logical value of 1 is applied to the switch terminal, while the switch 803 opens the individual terminal when the drive signal 259 of a logical value of 0 is applied. In other words, the drive signal 259 is a signal that turns on and off the corresponding switch 803 based on the ejection data 208. Thus, when the drive signal 259 of a logical value of 1 is applied, the piezo-electric element 704 contracts and expands to eject ink. On the other hand, when the drive signal 259 of a logical value of 0 is applied, the piezo-electric element 704 does not contract or expand and no ink is ejected.

As described above, an analog voltage (drive waveform 258) is applied to the common terminals of the piezo-electric elements 704, while the individual terminals are switched by digital signals (ejection data 208). This configuration simplifies the structure of the driver board 256.

Next, the pattern substrate 253 will be described with reference to FIGS. 5(1) and 5(2). The pattern substrate 253 is normally about 50 cm×50 cm, but recently substrates of 1 m or larger are used.

Figure 5:
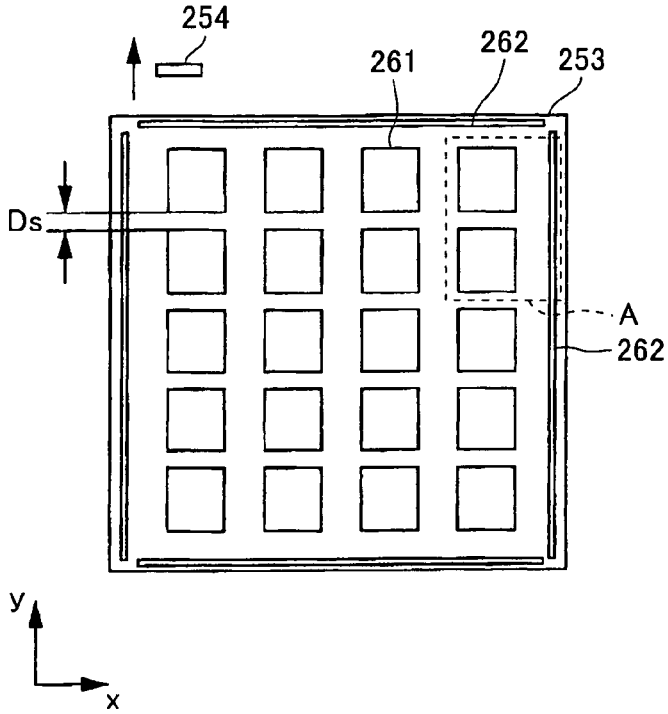
FIG. 5(1) is a plan view of a pattern substrate.
Figure 5:
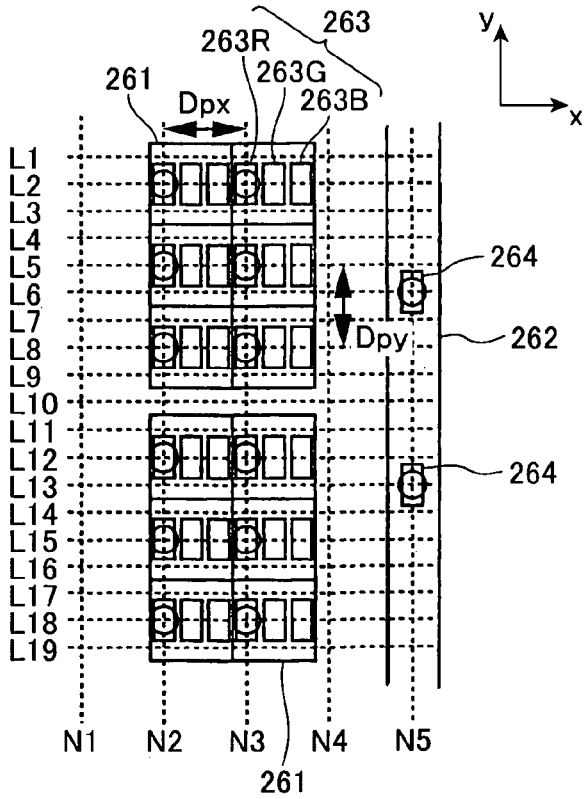

As shown in FIG. 5(1), the pattern substrate 253 includes a plurality of display cells 261 and test pixel areas 262. Display cells vary widely in size, from 2 inch square cells for mobile phones to 20 inch square or larger cells. In some cases, a single substrate includes display cells with different sizes. Peripheral circuitry may be provided between the display cells, in which case required spaces are left between the display cells. In this embodiment, as shown in FIG. 5(1), spaces are left between the display cells 261. The interval in y direction between the display cells 261 is Ds.

FIG. 5(2) is an enlarged view of an region A in FIG. 5(1). The display cells 261 are for color displays and include multiple rows (extends in x direction) and columns (extends in y direction) of sets of three pixels 263 (263R, 263G, 263B). The pixels 263R, 263G, and 263B are for red, green, and blue (RGB) colors, respectively. As shown in FIG. 5(2), in order to eject ink for one color in a display cell 261, ink can be ejected at fixed intervals (Dpx in x direction and Dpy in y direction). These intervals would normally be between 200 to 400 μm. Symbols "○" in FIG. 5(2) indicate where the ink droplets are ejected. Descriptions for the pixels 263R for red color will be provided below, and ink for green and blue is ejected in the same way.

As shown in FIG. 5(2), test pixels 264 are formed in the test pixel area 262. The y-direction positions of the test pixels 264 differ from the y-direction positions of the pixels 263R in the display cell 261. Also, the y-direction intervals between the test pixels 264 differ from the y-direction intervals between the pixels 263R in the display cell 261. That is, the test pixels 264 are located at is arbitrary positions which are on lines at 1 μm intervals.

To simplify description, the cell structure shown in FIG. 5(2) will be defined as below. First, the interval Dpx in x direction between the pixels 263R is 254 μm (100 ppi), which is the same as the nozzle pitch (nozzle interval) of the inkjet head 254. Although the interval Dpy in y direction between the pixels 263R is generally the same as Dpx, the interval Dpy will be defined as 3 μm in this embodiment for the sake of explanation. Also, two display cells 261 will be considered here. One display cell 261 involves six pixels 263R located at N2 and N3 in x direction and at L2, L5, and L5 in y direction, The other display cell 261 also involves six pixels 263R located at N2 and N3 in x direction and at L12, L15 and L18 in y direction. The interval between Ni (i=1,2,3, . . . ) in x direction is Dpx (−254 μm), and the interval between Li (i=1,2,3, . . . ) in y direction is 1 μm. The L8 to L12 interval between adjacent pixels between the above two display cells 261 is 4 μm, which differs from the 3 μm interval (for example, L2 to L5) between the pixels 263R in each display cell 261. This L8 to L12 interval (4 μm) also differs from integral multiples of the 3 μm interval between the pixels 263R in each display cell 261. The two test pixels 264 are located at N5 in x direction and at L6 and L13 in y direction, which are different y-direction positions from the y-direction positions of the pixels 263R in the display cells 261.

The data conversion software 202 will be described With reference to FIG. 6. The data conversion software 202 generates the ejection data 208 and the timing control data 207 from the pattern data 206. The pattern data 206 are data that describe the ejection pattern to be formed on the pattern substrate 253. The detailed data format will not be described here, and it is enough to say positions at which ink is ejected are described at an accuracy of 1 μm. The shaded positions in FIG. 6 indicate the pixels at which ink is ejected by the inkjet head 254.

In FIG. 6, the nozzle positions of the inkjet head 254 in x direction are indicated as N1, N2, . . . . The interval between the nozzles Ni (i=1,2,3, . . . ) are accurately fixed by head construction and are 254 μm in this embodiment. The positions of the inkjet head 254 in the main scanning direction (y direction) are indicated as L1, L2, . . . , L18, . . . . The y-direction encoder output 257 accurately determines the positions in the main scanning direction (y direction) of the inkjet head 254. When the length in y direction of the pattern substrate 253 is 1 m, for example, the lines Li continue up to 10 to the power 6.

As shown in FIG. 6, the timing control data 207 are defined for each line Li, and include the drive waveform generation timing data 209 and the ejection data transfer timing data 210. Each of the drive waveform generation timing data 209 is a bit signal that takes a logical value either 0 or 1. It is defined that a waveform is generated when the drive waveform generation timing data 209 has a logical value of 1, and that a waveform is not generated when the drive waveform generation timing data 209 has a logical value of 0. Each of the ejection data transfer timing data 210 is also a bit signal that takes a logical value either 0 or 1. It is defined that a data transfer is requested when the ejection data transfer timing data 210 has a logical value of 1, and that a data transfer is not requested when the ejection data transfer timing data 210 has a logical value of 0. Since the timing control data 207 are 2 bit data per line, the pattern substrate 253 that is 1 meter long will only require 256 kbyte data.

The drive waveform generation timing data 209 takes a logical value of 1 (generate drive waveform) at lines Li where at least one of nozzles N1 to N128 eject ink. Although the y-direction interval between pixels 263R is Dpy=3 μm in the example shown in FIG. 5(2) , in actual use the y-direction interval is larger and, for instance, 254 μm. In this case, only one line out of 254 lines takes a logical value of 1 when ink ejection needs to be done only at the pixels 263 in the display cells 261.

The ejection data transfer timing data 210 takes a logical value of 1 (request transfer of ejection data 208) only at lines Li where the drive waveform generation timing data 209 has a logical value of 1. Further, even when the drive waveform generation timing data 209 has a logical value of 1, the ejection data transfer timing data 210 takes a logical value of 0 when ink is ejected using the same ejection data 208 as the ejection data 208 which were previously transferred. In this case, transfer of the ejection data 208 is omitted. For example, since line L5 involves the same ejection data 208 as line L2, the ejection data transfer timing data 210 takes a logical value of 0 at L5 such that the ejection data 208 is not transferred again. Similarly, since line L12 involves the same ejection data 208 as line L8, the ejection data transfer timing data 210 takes a logical value of 0 at L12 such that transfer of the ejection data 208 is omitted. However, since line L8 involves different ejection data 208 from line L6, the ejection data transfer timing data 210 takes a logical value of 1 at L8 such that the ejection data 208 for L8 are transferred.

In the example in FIG. 5(2), the y-direction positions of the pixels 263R in the display cells 261 are repeated at regular intervals. Therefore, in case ink ejection needs to be done only at the pixels 263R in the display cells 261, only the ejection data 208 for the first time need to be transferred. This substantially reduces the amount of the ejection data 208. In the example shown in FIG. 6, the election data 208 for the pixels 263R in the display cells 261 are transferred at line L2. Thus, if ink ejection needs to be done only at the pixels 263R in the display cells 261, there is no need to transfer the ejection data 208 again. However, in this example, the ejection data 208 are transferred at line L6 to eject ink at the test pixels (N5, L6).

FIG. 7(1) shows the timing control data 207 and the ejection data 208 corresponding to the example shown in FIG. 6. For comparison, FIG. 7(2) shows ejection data transferred when all the ejection data for each 1 μm are transferred with a conventional method. With the conventional method, 5 bits of ejection data need to be transferred for each of the 19 lines (L1 to L19) amounting to a total of 95 bits. By contrast, in the present embodiment (FIG. 7(1)), 38 bits (2×19) of the timing control data 207 and 25 bits (5×5) of the ejection data 208 make a total of 63 bits, reducing a considerable amount of data. This difference becomes even greater in actual examples and substantially reduces the data volume.

As described above, the inkjet device 1 according to the present embodiment achieves ink ejection with high accuracy while minimizing the amount of data. In addition, ink ejection can be done accurately for regions including pixels with different intervals, such as the display cells 261 and the test pixel areas 262 in this embodiment.

Next, inkjet operation of the inkjet device 1 will be described. After starting up the controlling computer 201, an operator inputs pattern data 206 for the pattern substrate 253, which is subjected to the inkjet operation, into the controlling computer 201. The data conversion software 202 generates ejection data 208 and timing control data 207 based on the pattern data 206. The ejection data 208 and the timing control data 207 are stored into the memory board 205 and the timing control board 204, respectively. Then, the operator places the pattern substrate 253 onto the x-y stage 252.

The stage control software 203 of the controlling computer 201 controls the x-y stage 252 to move the substrate 253 in the x and y directions so as to determine the location of the substrate 253 in the x and y directions by using the optical system (not shown). Then, the stage control software 203 moves the substrate 253 to a predetermined starting location and starts main scanning in the y direction. The x-y stage 252 starts outputting y-direction encoder output 257 (resolution: 1 μm) to the timing control board 204.

The line counter 502 is cleared at the start of the operation. The line counter 502 counts the y-direction encoder output 257 and, at the same time, outputs a signal 503 to the internal memory 501. The signal 503 is input to the internal memory 501 as an address input for specifying an address of the internal memory 501. Then, the drive waveform generation timing data 209 and the ejection data transfer timing data 210 corresponding to a line L of the specified address are read out from the internal memory 501 and output to the delay pulse generators 504 and 505, respectively.

If the logical value of the drive waveform generation timing data 209 is 1, then the delay pulse generator 504 outputs the waveform generation trigger signal 506 to the drive waveform generator board 255 in synchronization with the y-direction encoder output 257. Also, if the logical value of the ejection data transfer timing data 210 is 1, then the delay pulse generator 505 outputs the data transfer request signal 507 to the memory board 205 in synchronization with the y-direction encoder output 257.

In this embodiment, 8-MHZ shift clock S-CK is input to the memory board 205 all the times. When the logical value of the data transfer request signal 507 changes from 0 to 1, then the memory board 205 outputs the ejection data 208 to the driver board 256, one bit at a time in synchronization with the shirt clock S-CK. The driver board 256 outputs the driving waveforms 259 corresponding to the piezoelectric elements 704 in accordance with the ejection data 208 transferred from the memory board 205. On the other hand, upon reception of the waveform generation trigger signal 506, the drive waveform generator board 255 generates driving waveform 258 and applies the same to the common terminal ends of the piezoelectric elements 704. As a result, ink is ejected from one or more nozzles 254N whose ejection data 208 has the logical value of 1. Thus ejected ink impinges onto the substrate 253.

After the main scanning in the y direction on the substrate 253 ends, the substrate 253 is moved in the x direction by a predetermined amount, and then the main scanning in the y direction is resumed. Repeating the above operation provides a desired pattern on the substrate 253 with ink droplets impinged on the substrate 253.

Figure 8:
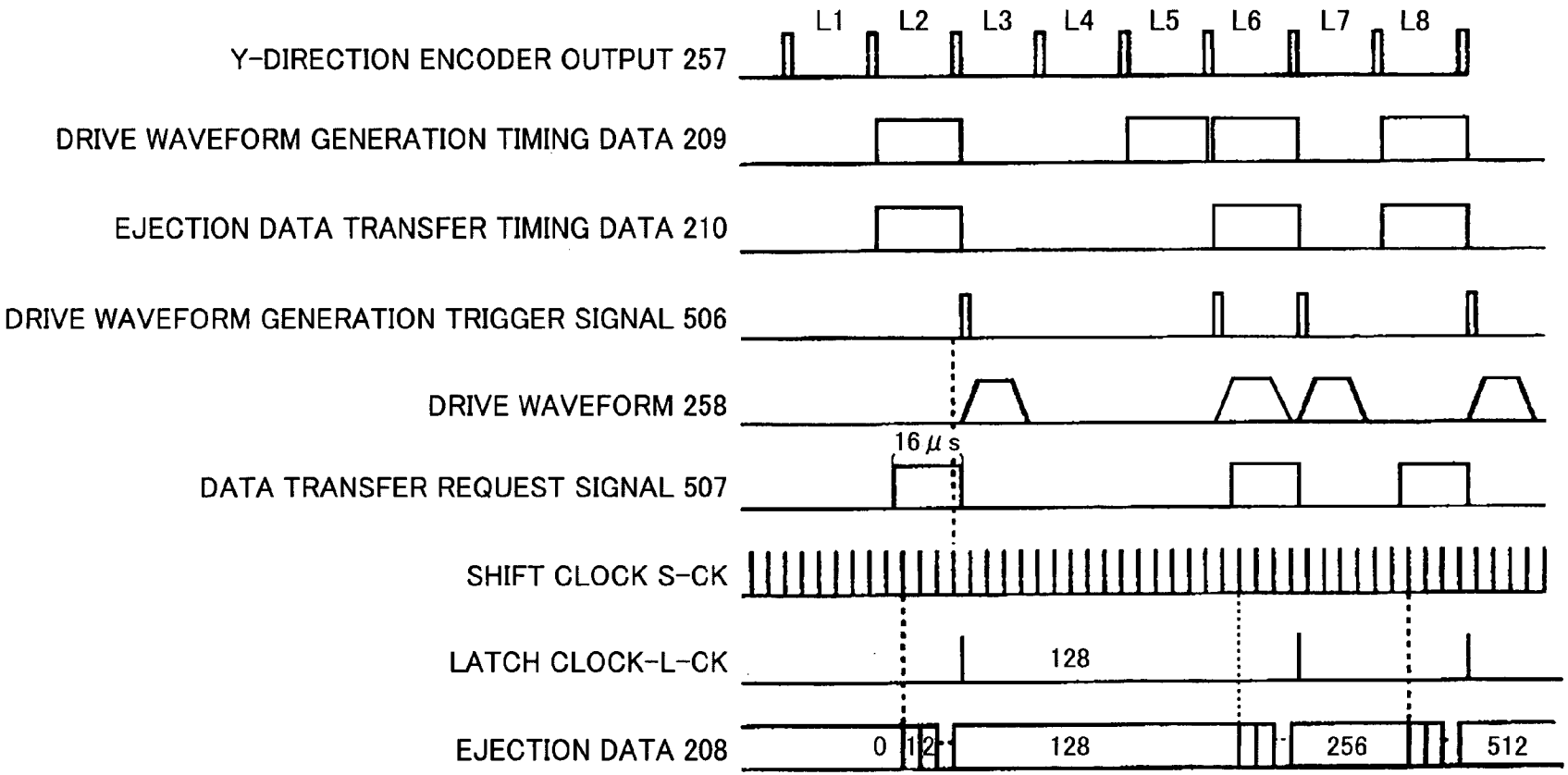
FIG. 8 is a timing chart of signals used in the inkjet device according to the first embodiment.

Next, operation for ejecting ink droplets onto pixel positions shown in FIG. 6 will be described with reference to the timing chart of FIG. 8. Lines L1, L2, . . . , shown in FIG. 8 are defined by the y-direction encoder output 257, In this embodiment, the main scanning speed in the y direction is 50 to 100 mm/s, and so the, average time interval of the y direction encoder output 257 is 10 to 20 μs.

First, at L1, the logical values of the drive waveform generation timing data 209 and the election data transfer timing data 210 are both 0. Therefore, ink ejection is not performed. At L2, the logical value of the ejection data transfer timing data 210 is 1, so that the delay pulse generator 505 outputs the data transfer request signal 507 a predetermined time after the y-direction encoder output 257, and the memory board 205 transfers the ejection data 208 to the 128 bit shift register 805 (FIG. 3). Here, the time width of the data transfer request signal 507 (time duration required to transfer the signal) is 16 μs, and the ejection data 208 is transferred in synchronization with the shift clock S-CK. After transfer of the 128 bit ejection data 208, the latch clock L-CK is generated, so that the ejection data 208 is latched to the 128 bit latch 804.

At line L2, the logical value of the drive waveform generation timing data 209 is 1. Therefore, the delay pulse generator 504 outputs the waveform generation trigger signal 506 a predetermined time after the y-direction encoder output 257, so that the drive waveform generator board 255 generates the predetermined driving waveform 258. As a result, ink droplets are selectively ejected in accordance with the ejection data 208.

At L3 and L4, the logical values of the drive waveform generation timing data 209 and the ejection data transfer timing data 210 are both 0, so that nothing happens as at L1.

At L5, the logical value of the ejection data transfer timing data 210 is 0, so that the ejection data 208 is not transferred. However, the logical value of the drive waveform generation timing data 209 is 1, so that the delay pulse generator 504 outputs the waveform generation trigger signal 506 a predetermined time after the y-direction encoder output 257, and the drive waveform generator board 255 generates the predetermined driving waveform 258. At this time, the ejection data 208 transferred and latched at L2 is already stored in the 128 bit latch 804. Therefore, ink is ejected in accordance with the ejection data 208 transferred at L2. In this manner, the inkjet operation is performed. The inkjet operation is performed by repeating this process.

Here, because the driving waveform 258 has a time width (10 to 30 μs), it takes several-line worth of time after the waveform generation trigger signal 506 is output until ink is actually ejected from the nozzle 254N. Therefore, it is necessary to generate the drive waveform generation timing data 209 before reaching a target pixel position.

Similarly, it takes predetermined time to complete transfer of the 128 bit ejection data 208 to the driver board 256 after generating the ejection data transfer timing data 210. Therefore, it is necessary to generate the ejection data transfer timing data 210 before reaching a target line L. Especially when operation is performed at high speed, it takes several-line worth of time to complete transfer of the 128 bit ejection data 208, and subsequent 128 bit ejection data 208 cannot be transferred during this time period. However, according to the present embodiment, it is unnecessary to transfer the ejection data 208 in succession, there is no danger that the ejection data 208 cannot be transferred even at high-speed operation.

Here, once the driving waveform 258 is generated, then a subsequent driving waveform 258 cannot be generated for a time duration equivalent to the time width of the driving waveform 258 (several-line worth of time). Therefore, this should be taken into consideration when preparing the pattern data 206.

In conventional techniques, the driving waveform 258 is repeatedly generated at predetermined time intervals. However, in the present embodiment, the driving waveform 258 is only generated when needed, and the inkjet unit 251 is usually in a standby mode (in a status not to generate the driving waveform 258). However, the drive waveform generation timing data 209 that determines the generation timing of the driving waveform 258 is defined at 1 μm, it is possible to impinge an ink droplet onto a target line L with an accuracy of 1 μm.

It should be noted that, in FIG. 8, each of the numbers (0, 1, 2, . . . , 126, , 256, 512) shown in the line of the ejection data 208 represents the number of the ejection data 208 that will be transferred to the driver board 256 next. That is, at the beginning, the ejection data 208 of No. 0 is waiting to be transferred. After 128 bit ejection data 208 (Nos. 0 to 127) is transferred at L2, then election data 208 of No. 128 waits to be transferred. After 128 bit ejection data 208 (Nos. 128 to 255) is transferred at L6, then ejection data 208 of No. 256 waits to be transferred next.

As described above, the inkjet device 1 of the present embodiment generates the timing control data 207, which contributes to highly precise positioning, and the ejection data 208, which contributes to low-resolution description within cells, separately. Therefore, generation timing of the driving waveform and transfer timing of the ejection data can be freely determined using the timing control data 201. As a result, ink droplets can be ejected highly precisely onto target positions without increasing data amount.

Figure 9:
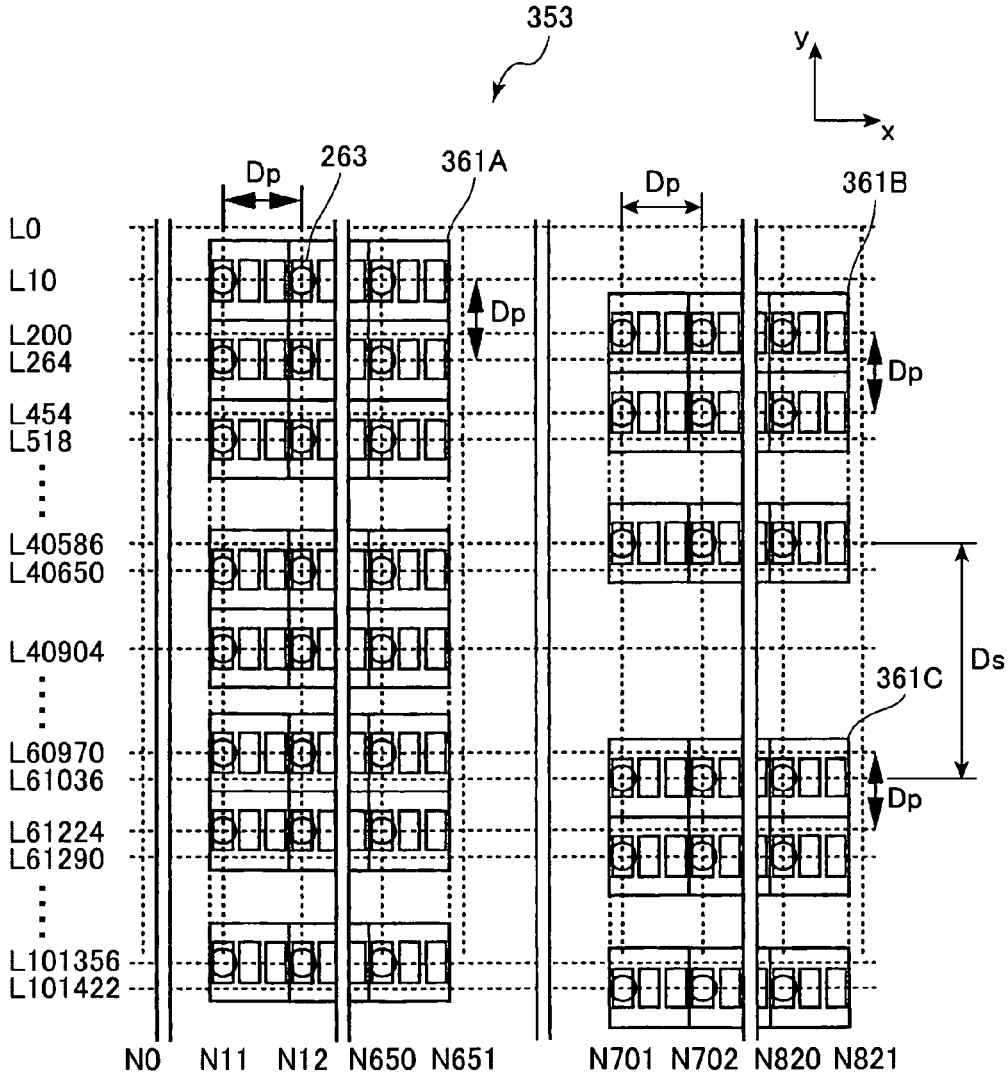
FIG. 9 is an explanatory diagram showing another pattern substrate recorded by the inkjet device according to the first embodiment.
Figure 10:
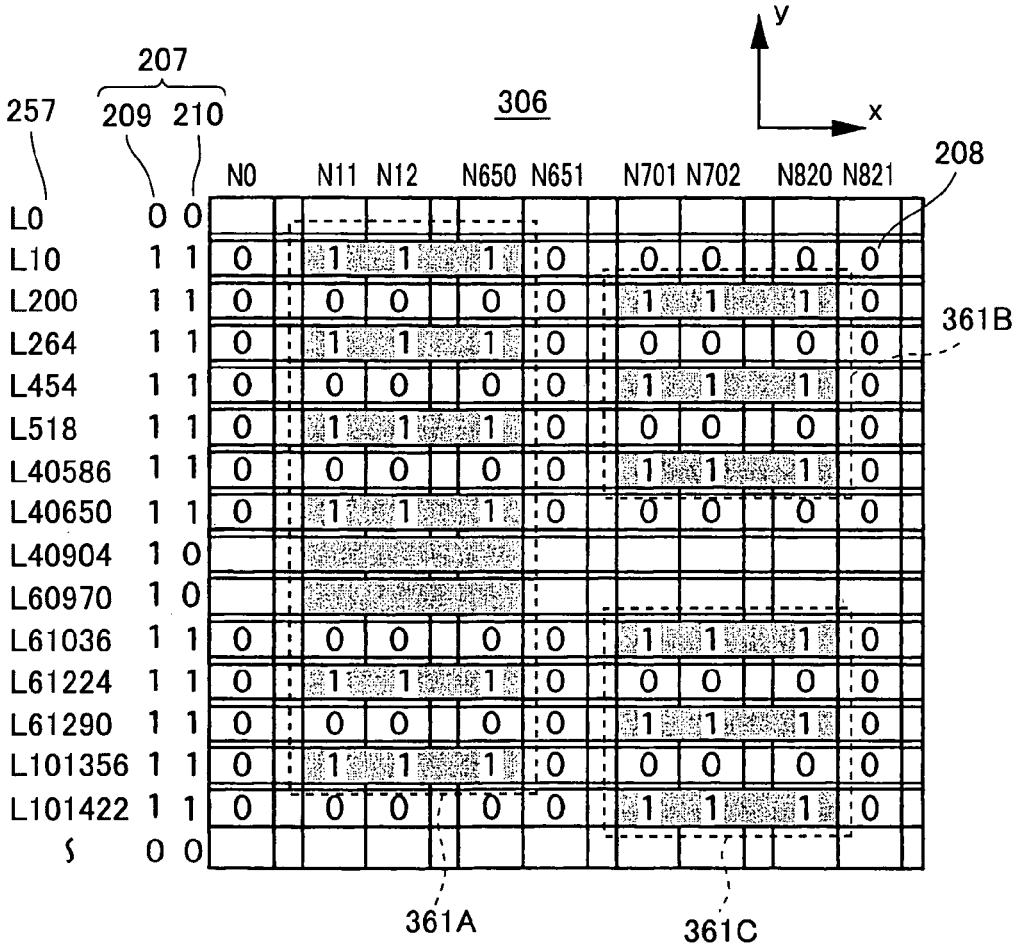
FIG. 10 is an explanatory diagram of data conversion s software that generates ejection data and timing control data from pattern data in an example of recording another substrate shown in FIG. 9.

Next, explanation will be provided for when the inkjet operation is performed on a substrate 353 using the inkjet device 1 with reference to FIGS. 9 and 10.

The substrate 353 shown in FIG. 9 includes display cells 361A, 361B, and 361C. The sizes of the display cells 361A-361C are close to those of actual use and are much larger than those in the substrate 253 of FIG. 2.

Specifically, the display cell 361A includes 400 pixels in the y direction and 640 pixels in the x direction. The ink-ejection pitch DP is 254 μm both in the x and y directions. The inkjet device 1 ejects ink droplets onto 400 lines in total, L1 and every 254 th line after L10 in the y direction (L10, L264, . . . , L101356), using 640 nozzles (from N11 to N651). The display cell 361B includes 160 pixels in the y direction and 120 pixels in the x direction. Ink-ejection pitch Dp is 254 μm both in the x and y directions. The inkjet device 1 ejects ink droplets onto 160 lines in total, L200 and every 254 th line after L200 (L200, L454, . . . , L40586), using 120 nozzles (N701 to N820). The display cell 361C includes 160 pixels in the y direction and 120 pixels in the x direction. Ink-ejection pitch Dp is 254 μm both in the x and y directions. The inkjet device 1 ejects ink droplets onto 160 lines in total, L61036 and every 254 th line after L61036 (L61036, L61290, . . . , L101422), using 120 nozzles (N701 to N820).

An interval Ds between the display call 361B and the display cell 361C (between L40586 and L61036) in the y direction is 20450 μm. In this example also, the interval Ds is not a multiple of the ink-ejection pitch Dp=254 μm. Therefore, the inkjet operation cannot be continued while keeping the interval Dp in the previous cell because this will displaces the impinging positions of ink droplets. Thus, even if the interval Dp in each display cell is the same, the phase must be adjusted for pixels in a subsequent display cell. That is, positions to impinge ink droplets must be determined in accordance with the interval Ds between the cells.

Next, ejection data 206 and timing control data 207 generated based on pattern data 306 will be described with reference to FIG. 10. It should be noted that, except for the first line L0 and lines after L101422, FIG. 10 shows only representative lines 257 of which the drive waveform generation timing data 209 has a logical value of 1 (L10, L200, L264. . . ).

Lines where the ejection data transfer timing data 210 has the logical value of 1 (requesting transfer) are only lines where the logical value of drive waveform generation timing data 209 is 1. Further, if ink ejection is possible using previously transferred ejection data 208, then the ejection data transfer timing data 210 takes the logical value of 0 so that data transfer is omitted. For example, in a region from L40650 to L60970, only ink ejection is performed for the display cell 361A, and not for the display cells 361B and 361C. Accordingly, the ejection data 208 transferred at L40650 can be used at different lines in this region, i.e., L40904, L41158 . . . and L60970 (every 254th line). Therefore, the ejection data transfer timing data 210 at these lines L40904, L41158 . . . and L60970 has the logical value of 0, so that data transfer is omitted, thereby substantially reducing the amount of data that has to be generated.

Also, the ejection data 208 is not transferred unless ink ejection is actually performed (for example, at L200, L264, L61224, L61290, and the like). Therefore, even in a region where the pixels 263 of both the display cells 361A and 361B exist or in a region where the pixels 263 of both the display cells 361A and 361C exist, the data amount can be vastly reduced.

As described above, even when the interval Ds is not a multiple of the ink-ejection pitch Dp, the inkjet device 1 can eject ink droplets accurately on the target pixels 261 without Increasing the amount of data.

Next, an inkjet device 401 according to a second embodiment of the present invention will be described with reference to FIGS. 11 to 14. The inkjet device 401 of this embodiment has the same configuration as that of the above-described inkjet device 1, except in that the inkjet device 401 includes a driver board 456 shown in FIG. 11 and a timing control board 404 shown in FIG. 12 and in that data differing from the timing control data 207 is generated by the data converting software 202. Accordingly, only the driver board 456, the timing control board 404, and the data generated by the data converting software 202 will be described below.

Figures 11, 13:
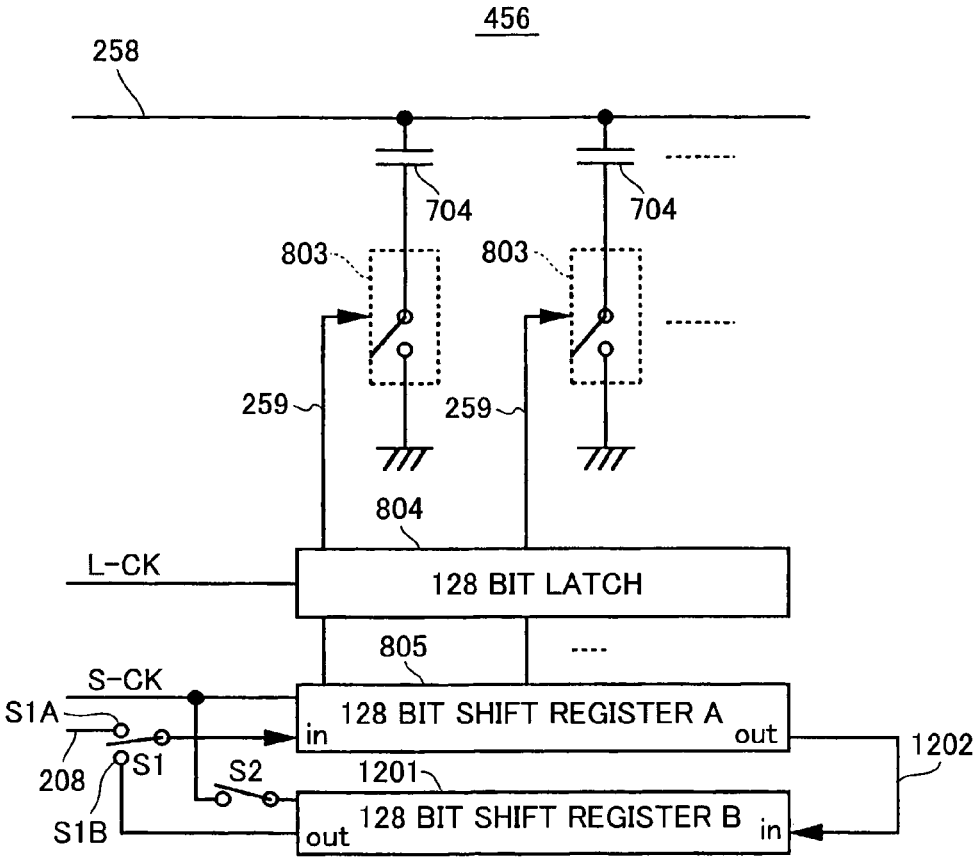
FIG. 11 is an explanatory diagram showing the construction of a driver board of an inkjet device according to a second embodiment of the present invention.
FIG. 13 is a table showing timing control data and related data used in the inkjet device according to the second embodiment.
Figure 12:
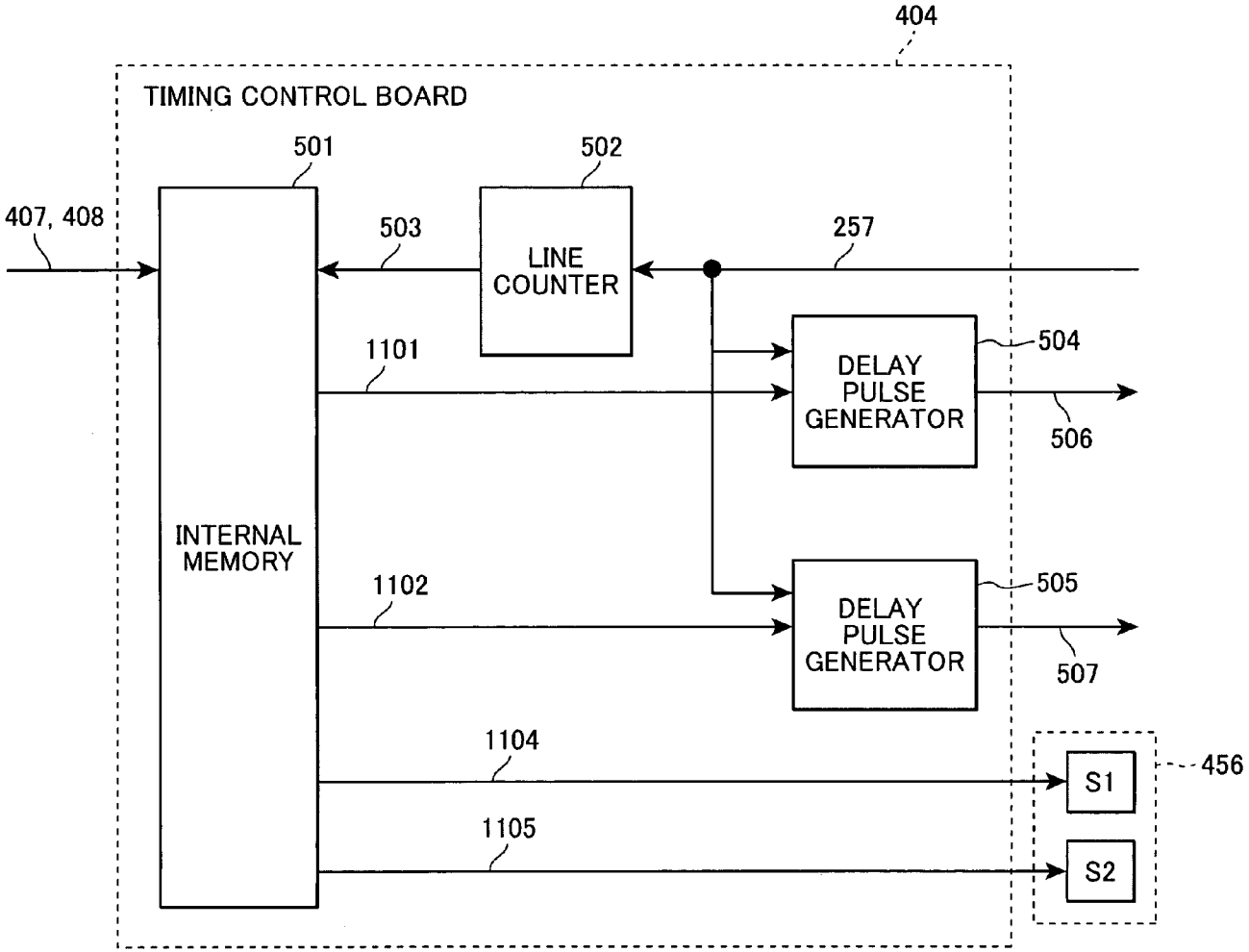
FIG. 12 is a block diagram showing the construction of a timing control board of the inkjet device according to the second embodiment.

As shown in FIG. 11, the driver board 956 of this embodiment differs from the driver board 256 shown in FIG. 3 in that the driver board 456 includes a 128-bit shift register 1201 (hereinafter referred to as "shift register B1201) In addition to the 128-bit shift register 905 (hereinafter referred to as "shift register A805) . Like the shift register A805, the shift register B1201 is a normal shift register that receives serial data and outputs parallel or serial data. The shift register A805 has a serial-input 805in and a serial-output 805out Similarly, the shift register B1201 has a serial-input 1201in and a serial-output 1201out.

The driver board 456 further includes switches S1 and S2. The switch 91 can be switched between a terminal S1A and a terminal S1B. The switch 32 can be switched between open and closed.

The timing control board 404 differs from the above-described timing control board 204 (FIG. 2) in that the timing control board 404 can output switch signals 1104 and 1105 to the switches S1 and S2 of the driver board 456, is respectively.

Switching control for switching the switches S1 and S2 will be described. The data converting software 202 determines one of modes M0 to M4 to be described later based on a timing control data 407 shown in FIG. 13, which includes a most significant bit 1101, a second bit 1102, and a least significant bit 1103, and then generates switch signals 408 (1104 and 1105) for the twitches S1 and S2, based on the determined mode. The switch signals 1104 and 1105 are transmitted to the switches S1 and S2, respectively, via the internal memory 501 of the timing control board 404, so as to switch the status of the switches S1 and S2.

As shown in FIG. 11, when the switch S1 is connected to the terminal S1A, then the serial-input 805in of the shift register A805 can receive the ejection data 208 on the other hand, when the switch 31 is connected to the terminal 81B, then the serial-input 805in of the shift register A805 can receive output data from the serial-output 1201 out of the shift register B1201. When the switch S2 is closed, the shift clock S-CK is input to the shift register B1201. When the switch S2 is open, then the shift clock S-CK is not input to the shift register B1201.

Also, the serial-output 805out of the shift register A805 is connected to the serial-input 1201in of the shift register B1201 via a signal line 1202, so that output data from the serial-output 805out of the shift register A805 is input to the serial-input 1201in of the shift register B1201.

Figure 14:
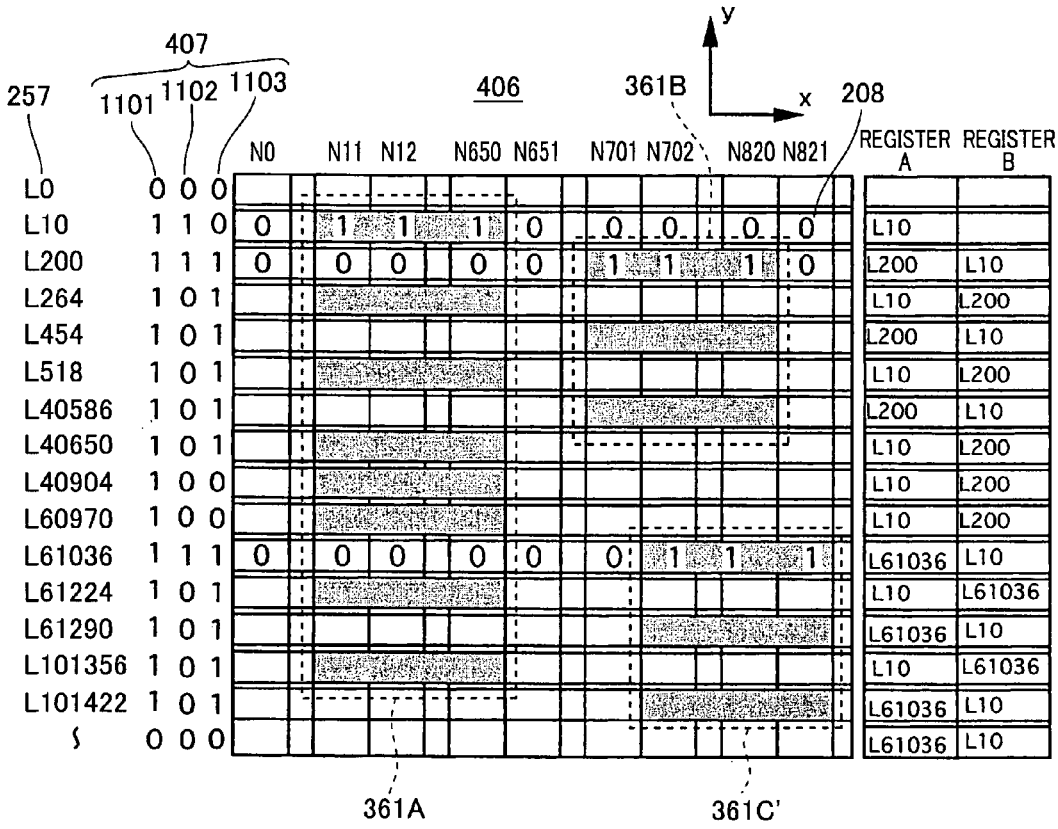
FIG. 14 is an explanatory diagram of data conversion software that generates ejection data and timing control data from pattern data in the inkjet device according to the second embodiment.

FIG. 13 shows the timing control data 407 and various relating data according to the present embodiment. The timing control data 407 is generated by the data converting software 202 based on pattern data 406 (FIG. 14).

Five modes M0–M4 are shown in an uppermost line in FIG. 13. The timing control data 407 is shown in second to third lines (area inside heavy-line frame). The timing control data 407 is defined for each line L and includes the most significant bit 1101 (2 to the power 2), the second bit 1102 (2 to the power 1), and the least significant bit 1103 (2 to the power 0). The most significant bit 1101 indicates whether or not to generate the drive waveform 258, and takes a logical value of 1 indicating "generate" or a logical value of 0 indicating "not generate". The second bit 1102 indicates whether or not to transfer the ejection data 208, and takes a logical value of 1 indicating "transfer" or a logical value of 0 indicating "not transfer". The least significant bit 1103 indicates whether or not to rotate data between the shift register A805 and the shift register B1201 in a manner described later, and takes a logical value of 1 indicating "rotate", a logical value or 0 indicating "not rotate". Here, asterisks in FIG. 13 indicate that the least significant bit 1103 can take any logical value. The combination of these 3 bits of the timing control data 401 defines the five modes M0 to M4.

Fifth to eighth lines in FIG. 13 indicate status of the latch clock L-CK and shift clock S-CK and status of the switches S1 and S2 in each mode. More specifically, in the fifth line, it is indicated whether or not to generate the latch clock L-CK. A logical value of 1 indicates "generate", and a logical value of 0 indicates "not generate". In the sixth line, it is indicated whether or not to input the shift clock S-CK to the shift register B1201, A logical value of 1 indicates "input", and a logical value of 0 indicates "not input". In the seventh line, a terminal to which the switch S1 is connected to is indicated. S1A indicates "terminal S1A", and S1B indicates "terminal S1B". Asterisks indicate that the switch S1 can be connected to either the terminal S1A or S1. In the eighth line, the status of the switch S2 is indicated. Asterisks indicate that the switch S2 can be either opened or closed.

Next, explanation will be provided for each mode M0-M4. In the mode M0, the driving waveform 258 is not generated, so ink ejection is not performed Accordingly, the ejection data 208 is not transferred. The latch clock L-CK nor the shift clock S-CK is output. The switches S1 and S2 can be in any status.

The mode M1 is a waveform generation mode without data rotation and is similar to the mode M0, but differs only in that the drive waveform 258 is generated in the mode M1 so that ink ejection is performed.

The mode M2 is a waveform generation mode with data rotation. In the mode M2, the switch S1 is connected to the terminal S1B, so that the serial-output 1201out of the shift register B1201 is connected to the serial-input 805in of the shift register A805. Because the switch S2 is closed, the shift clock S-CK is input to both the shift register A805 and the shift register B1201. Accordingly, the ejection data 208 previously stored in the shift register A805 is input to the shift register B1201 via the signal line 1202, and the ejection data 209 previously stored in the shift register B1201 is input to the shift register A805 via the switch S1, That is, the contents of the shift register A805 and the contents of the shift register B1201 are switched. This is referred to as "data rotation". After data rotation completes, the latch clock L-CK is generated. As a result, the ejection data 208 stored in the shift register A805 is latched to the latch 804. The ejection data 208 latched to the latch 804 in this manner is the data previously stored in the shift register B1201.

The mode M3 is a data transfer mode without data rotation. The switch S1 is connected to the terminal S1A, so that the ejection data 208 transferred from the memory board 205 is input to the serial-input 805in of the shift register A805. Also, because the switch S2 is opened, the shift clock S-CK is input to the shift register A805, but is not input to the shift register B1201. Therefore, in the mode M3, the driver board 456 operates in the same manner as the above-described driver board 256 when both the drive waveform generation timing data 209 and the ejection data transfer timing data 210 have the logical value of "1". That is, the ejection data 208 previously stored in the shift register A805 is replaced by ejection data 208 newly transferred from the memory board 205. On the other hand, the ejection data 208 stored in the shift register B1201 is retained.

The mode M4 is a data transfer mode with data rotation. The switch S1 is connected to the terminal S1A, so that the serial-input 805in of the shift register A805 can receive the ejection data 208 transferred from the memory board 205. Because the switch S2 is closed, the shift clock S-CK is input to both the shift register A805 and the shift register B1201. Therefore, the ejection data 208 transferred from the memory board 205 is input to the shift register A805, and the ejection data 208 previously stored in the shift register A805 is input to the shift register B1201 by data rotation. At this time, the ejection data 208 previously stored in the shift register B1201 is erased.

Next, the timing control data 407 and the ejection data 208 according to the present embodiment will be described with reference to FIG. 14. The timing control data 407 and the ejection data 208 are both generated based on pattern data. In this example, pattern data 406 is used. The pattern data 406 is similar to the pattern data 306 shown in FIG. 10, but differs in that a location of a display cell 361C' is shifted one nozzle position to the right from the display cell 361C. Thus, a region of the display cell 361C' in the x direction is N702 to N821.

As described above, the timing control data 407 is defined for each line L and includes the most significant bit 1101, the second bit 1102, and the least significant bit 1103.

FIG. 14 also shows, in two right columns (register A, register B), the ejection data 208 to be stored in the shift register A805 and that to be stored in the shift register B1201 at each line L. For example, at line L264, L10 is shown in the register A, and L200 is shown in the register B. This indicates that, at the line L264, the ejection data 208 of L10 is stored in the shift register A805, and the ejection data 208 of L200 is stored in the shift register B1201.

Next, the pattern data 406 will be described for each line L. The driver board 456 is in the mode M0 (idle mode) at lines L0 to L9, prior to L10 where ink ejection is first performed for the display cell 361A. Therefore, the driving waveform 258 is not generated, so that ink ejection is not performed. At line L10, the driver board 456 is in the mode M3 (data-transfer mode without data rotation). Therefore, the ejection data 208 (0 . . . 11 . . . 10 . . . 00 . . . 00 . . . ) is transferred. Then, the driving waveform 258 is generated to eject ink droplets. At the lines L11–L199, the driver board 456 is in the mode M0 (idle mode), so ink ejection is not performed. At L200 where ink ejection is first performed for the display cell 361B, the driver board 456 is in the mode M4 (data transfer mode with data rotation), so that the ejection data 208 (0 . . . 00 . . . 00 . . . 11 . . . 10 . . . ) of L200 is input to the shift register A805. Then, the drive waveform 258 is generated to eject ink droplet. In this manner, the inkjet operation is performed. At this time, the ejection data 208 (0 . . . 11 . . . 10 . . . 00 . . . 00 . . . ) of L10 previously stored in the shift register A805 is moved into the shift register B1201.

In the following, operation only in the modes other than the mode M0 will be described. Between lines L264 to L40650, at L264 and at every 254 th line after L264 (L264, L518, . . . , L40650, the driver board 456 is in the mode M2 (waveform generation mode with data rotation). Therefore, ejection data 208 of L10 stored in the shift register B1201 is moved to the shift register A805, and then ink ejection is performed. Between lines L454 and L40586, at L454 and at every 254th line after L454 (L454, . . . , L40586) also, the driver board 456 is in the mode M2 (waveform generation mode with data rotation). Therefore, at these lines L, the ejection data 208 of L200 stored in the shift register B1201 is moved to the shift register A805, and then the ink ejection is performed.

Between L40904 and L60970, at L40904 and at every 254th line L after L40904 (L40904, . . . , L60970), the driver board 456 is in the mode M1 (waveform generation mode without data rotation). Therefore, at these lines, the ejection data 208 of L10 having been stored in the shift register A805 is used for ink ejection.

At line L61036 where ink ejection is first performed for the display cell 361C', the driver board 456 is in the mode M4 (data transfer mode with data rotation) Therefore, the ejection data 208 (0 . . . 00 . . . 00 . . . 01 . . . 11 . . . ) of L61036 is transferred from the memory board 205 to the shift register A805. Accordingly, the ejection data 208 of L61036 is stored into the shift register A805. At this time, the ejection data 208 previously stored in the shift register A805 moves into the shift register B1201 by data rotation. Then, the driving waveform 258 is generated, and so the ink ejection is performed.

Thereafter, between L61224 and L101356, at L61224 and at every 254th line after L61224 (at L61224, . . . , L101356), the driver board 456 is in the mode M2 (waveform generation mode with data rotation). At these lines, the ejection data 208 of L10 previously stored in the shift register B1201 is moved into the shift register A805, and then the ink ejection is performed.

Also, between L61290 and L101422, at L61290 and at every 254th line after L61290, the driver board 456 is in the mode M2 (waveform generation made with data rotation), so that the ejection data 208 of L61036 stored in the shift register B1201 is moved into the shift register A805 by the data rotation, and the ink ejection is performed.

As described above, according to the inkjet device 401 of the present embodiment, the amount of data to transfer can be further reduced compared with the above-described inkjet device 1.

While the invention has been described in detail with reference to the specific embodiment thereof, it would be apparent to those skilled in the art that various changes and modifications may be made therein without departing from the spirit of the invention.

For example, a medium on which the inkjet device ejects ink droplets is not limited to a glass substrate or the like, but could be sheet of paper, printed Substrate, or any other medium that can be placed at a distance from the print head.

The ink used in the inkjet devices could be water-based ink, oil-based ink, solvent ink, metal ink, luminescent materials, filter materials, or the like, provided ink droplets can be ejected in response to a piezoelectric drive signal.

In the above embodiments, the inkjet device 1, 401 includes the single inkjet head 254. However, the inkjet device 1, 401 could include two or more ink jet heads 254 depending on the resolution of display pixels. Also, in the above embodiments, the plurality of nozzles 254N are aligned in the x direction. However, the nozzle line could extend at an angle with respect to the x direction.

The inkjet device 401 of the above-described second embodiment includes the single shift register B1201. However, the inkjet device 401 could include two or more shift registers B1201. In this case, the amount of data to transfer is further reduced.

In the first and second embodiments, the driving signal 259 could be a different signal depending on the corresponding piezoelectric element 704 so as to suppress manufacturing variation of the piezoelectric element 704 For examples the driving signal 259 could be a signal that controls ON/OFF of the switch 803 and also controls ON-time duration of the switch 803, based on both the ejection data 208 and data indicating ON-time percentage. Specifically, the switch 803 could be a turned ON for a time duration 100% of the driving waveform 258 or 95% of the driving waveform 258. Changing the ON-time duration of the switch 803 can control the level of voltage that is applied to the piezoelectric element 704.

What is claimed is:

1. An inkjet device comprising:

an inkjet head having multiple nozzles arranged at equally spaced intervals in a row, the inkjet head ejecting ink droplets from the multiple nozzles onto target pixels on a medium;

a conveying unit that conveys the medium in a first direction relative to the inkjet head, wherein a plurality of lines are defined on the medium, each of the plurality of lines extending in a second direction that is orthogonal to the first direction;

a data generating unit that generates both ejection data and timing control data from pattern data, the ejection data being generated for each of specific lines selected from the plurality of lines based on predetermined criteria, the timing control data being generated for each of the plurality of lines;

a drive-waveform-generation-signal generating unit that generates a drive-waveform generation signal in accordance with the timing control data;

a transfer-signal generating unit that generates a transfer signal in accordance with the timing control data;

a drive-waveform generating unit that generates a drive waveform in accordance with the drive-waveform generation signal;

an ejection-data transferring unit that transfers the ejection data in accordance with the transfer signal; and a control unit that controls, based on the drive waveform and the ejection data transferred from the ejection-data transferring unit, the inkjet head to selectively eject ink droplets from the multiple nozzles.

2. The inkjet device according to claim 1, further comprising a conveying unit that conveys the medium in a first direction relative to the inkjet head, wherein:

a plurality of lines are defined on the medium, each of the plurality of lines extending in a second direction that is orthogonal to the first direction;

the plurality of lines has an interval in the first direction that is smaller than a minimum ejection frequency of each of the multiple nozzles; and the timing control data are defined for each of the plurality of lines, and include drive-waveform generation timing data, which determine whether to generate the drive waveform for the each of the plurality of lines, and ejection-data transfer timing data, which determine whether to transfer the ejection data for each of the plurality of lines.

3. An inkjet device comprising:

an inkjet head having multiple nozzles arranged at equally spaced intervals in a row, the inkjet head ejecting ink droplets from the multiple nozzles onto target pixels on a medium;

a data generating unit that generates both ejection data and timing control data from pattern data;

a drive-waveform-generation-signal generating unit that generates a drive-waveform generation signal in accordance with the timing control data;

a transfer-signal generating unit that generates a transfer signal in accordance with the timing control data;

a drive-waveform generating unit that generates a drive waveform in accordance with the drive-waveform generation signal;

an ejection-data transferring unit that transfers the ejection data in accordance with the transfer signal;

a control unit that controls, based on the drive waveform and the ejection data transferred from the ejection-data transferring unit, the inkjet head to selectively eject ink droplets from the multiple nozzles; and a conveying unit that conveys the medium in a first direction relative to the inkjet head, wherein:

a plurality of lines are defined on the medium, each of the plurality of lines extending in a second direction that is orthogonal to the first direction;

the plurality of lines has an interval in the first direction that is smaller than a minimum ejection frequency of each of the multiple nozzles;

the timing control data are defined for each of the plurality of lines;

the drive-waveform generating unit generates the drive waveform only at lines which include at least one of the target pixels; and the ejection-data transferring unit transfers the ejection data only at lines which include at least one of the target pixels and at which the ink droplets are ejected based on ejection data different from previously transferred ejection data.

4. The inkjet device according to claim 1, further comprising a data-rotation-instructing-signal generating unit that generates a data-rotation instructing signal in accordance with the timing control data, wherein the control unit includes an ejection shift register that stores ejection data, at least one storage shift register that stores ejection data, and a data rotating unit that rotates the ejection data between the ejection shift register and the at least one storage shift register in accordance with the data-rotation instructing signal.

5. The inkjet device according to claim 4, wherein the control unit controls the inkjet head based on the ejection data stored in the ejection shift register.

6. A control method for controlling an inkjet device, the control method comprising the steps of:

a) conveying a medium in a first direction relative to an inkjet head, wherein a plurality of lines are defined on the medium, each of the plurality of lines extending in a second direction that is orthogonal to the first direction;

b) generating ejection data and timing control data from pattern data, the ejection data being generated for each of specific lines selected from the plurality of lines based on predetermined criteria, the timing control data being generated for each of the plurality of lines;

c) generating a drive-waveform generation signal in accordance with the timing control data;

d) generating a transfer signal in accordance with the timing control data;

e) transferring the ejection data to a register in accordance with the transfer signal;

f) generating a drive waveform in accordance with the drive-waveform generation signal, and g) controlling, based on the drive waveform generated in step d) and the ejection data stored in the register, an inkjet head to selectively eject ink droplets from multiple nozzles of the inkjet head onto target pixels on a medium.

7. The control method according to claim 6, wherein the timing control data are defined for each of a plurality of lines defined on the medium, and include drive-waveform generation timing data and ejection-data transfer timing data, the drive-waveform generation timing data determining whether to generate the drive waveform for the each of the plurality of lines, the ejection-data transfer timing data determining whether to transfer the ejection data for each of the plurality of lines, each of the plurality of lines extending in a first direction that is orthogonal to a second direction in which the medium is conveyed relative to the inkjet head, the plurality of lines having an interval in the second direction that is smaller than a minimum ejection frequency of each of the multiple nozzles.

8. The control method according to claim 6, further comprising the steps of:

h) generating a data-rotation instructing signal in accordance with the timing control data, and i) rotating ejection data between the register and a storage register in accordance with the data-rotation instructing signal.

9. A control method for controlling an inkjet device, the control method comprising the steps of:

a) generating ejection data and timing control data from pattern data;

b) generating a drive-waveform generation signal in accordance with the timing control data;

c) generating a transfer signal in accordance with the timing control data;

d) transferring the ejection data to a register in accordance with the transfer signal;

e) generating a drive waveform in accordance with the drive-waveform generation signal; and f) controlling, based on the drive waveform generated in step d) and the ejection data stored in the register, an inkjet head to selectively eject ink droplets from multiple nozzles of the inkjet head onto target pixels on a medium, wherein:

the timing control data are defined for each of a plurality of lines defined on the medium, each of the plurality of lines extending in a first direction that is orthogonal to a second direction in which the medium is conveyed relative to the inkjet head, the plurality of lines having an interval in the second direction that is smaller than a minimum ejection frequency of each of the multiple nozzles; the drive waveform is only generated in step e) at lines which include at least one of the target pixels; and the ejection data is transferred in step d) only at lines which include at least one of the target pixels and at which the ink droplets are ejected based on ejection data different from previously transferred ejection data.

10. An inkjet device comprising:

an inkjet head having multiple nozzles arranged at equally spaced intervals in a row, the inkjet head ejecting ink droplets from the multiple nozzles onto target pixels on a medium;

a data generating unit that generates both ejection data and timing control data from pattern data;

a drive-waveform-generation-signal generating unit that generates a drive-waveform generation signal in accordance with the timing control data;

a transfer-signal generating unit that generates a transfer signal in accordance with the timing control data;

a drive-waveform generating unit that generates a drive waveform in accordance with the drive-waveform generation signal;

an ejection-data transferring unit that transfers the ejection data in accordance with the transfer signal;

a control unit that controls, based on the drive waveform and the ejection data transferred from the ejection-data transferring unit, the inkjet head to selectively eject ink droplets from the multiple nozzles; and a conveying unit that conveys the medium in a first direction relative to the inkjet head, wherein:

a plurality of lines are defined on the medium, each of the plurality of lines extending in a second direction that is orthogonal to the first direction;

the plurality of lines has an interval in the first direction that is smaller than a minimum ejection frequency of each of the multiple nozzles; and the timing control data are defined for each of the plurality of lines and include drive-waveform generation timing data, which determine whether to generate the drive waveform for the each of the plurality of lines, and ejection-data transfer timing data, which determine whether to transfer the ejection data for each of the plurality of lines, wherein each of the drive-waveform generation timing data is a bit signal that selectively takes either a first logical value or a second logical value, such that a waveform is generated when the drive-waveform generation timing data has the second logical value;

wherein each of the ejection-data transfer timing data is a bit signal that selectively takes either a first logical value or a second logical value, such that a data transfer is requested when the ejection-data transfer timing data has the first logical value, and that a data transfer is not requested when the ejection-data transfer timing data has the second logical value;

wherein the drive-waveform generation timing data takes the first logical value only at lines where at least one of the plurality of nozzles ejects ink droplets; and wherein the ejection-data transfer timing data takes the first logical value only at lines where the drive-waveform generation timing data has the first logical value and also ink droplets are ejected using ejection data different from ejection data which are previously transferred.

* * * * *